US007174956B2

(12) United States Patent
Williams et al.

(10) Patent No.: US 7,174,956 B2
(45) Date of Patent: Feb. 13, 2007

(54) STRIPPER RUBBER ADAPTER

(76) Inventors: John R. Williams, 4800 Williams Dr. #212-404, Georgetown, TX (US) 78628; Charles T. Bishop, 4085 McRay Ave., Springdale, AR (US) 72782

( * ) Notice: Subject to any disclaimer, the term of this patent is extended or adjusted under 35 U.S.C. 154(b) by 312 days.

(21) Appl. No.: 10/776,325

(22) Filed: Feb. 11, 2004

(65) Prior Publication Data

US 2005/0173127 A1 Aug. 11, 2005

(51) Int. Cl.
*E21B 33/068* (2006.01)

(52) U.S. Cl. ..... 166/85.3; 175/209; 175/214

(58) Field of Classification Search ..... 411/351; 403/355, 356, 231; 166/85.3; 175/209, 175/214

See application file for complete search history.

(56) References Cited

U.S. PATENT DOCUMENTS 1,980,336 A * 11/1934 Hoagland ..... 82/147

4,949,796 A * 8/1990 Williams ..... 175/209

* cited by examiner

*Primary Examiner*—Willilam Neuder
(74) *Attorney, Agent, or Firm*—Matthew E. Burr

(57) ABSTRACT

A connector is provided for selectively connecting or disconnecting a stripper rubber to or from drilling head equipment such as a bearing assembly. A generally cylindrical adapter connected to the equipment defines a primary bore to accommodate a down hole tubular. One or more cam pin bores, adapted to house one ore more cam pins, are positioned radially around the adapter substantially parallel to the primary bore. One or more cam lock bores adapted to house one or more at least partially rotatable cam locks, are offset from the pin cam bores such that each cam pin bore partially intersects a corresponding cam lock bore to form an aperture through which the cam lock engages the cam pin. One or more cam pins are connected to the stripper rubber; and one or more at least partially rotatable cam locks housed in the cam lock bores of the adapter optionally engage or disengage the pin cams to respectively connect or disconnect the stripper rubber to or from the equipment.

6 Claims, 4 Drawing Sheets

STRIPPER RUBBER ADAPTER

FIELD OF THE INVENTION

The present invention relates to drilling heads and rotating blowout preventers or diverter/preventers for oil and gas wells and more particularly, to apparatus, systems and methods for connecting or disconnecting a stripper rubber to or from equipment of a drilling head, such as the bearing assembly, to pressure-seal the interior of the well bore for the circulation, containment or diversion of drilling fluid through the well during drilling operations.

BACKGROUND OF THE INVENTION

Oil, gas, water and geothermal wells are typically drilled with a drill bit connected to a hollow drill string which is inserted into a well casing cemented in the well bore. A drilling head is attached to the well casing, wellhead or to associated blowout preventer equipment, for the purposes of sealing the interior of the well bore from the surface and facilitating forced circulation of drilling fluid through the well while drilling or diverting drilling fluids away from the well. Drilling fluids include, but are not limited to, water, steam, drilling muds, air, and other gases.

In the forward circulation drilling technique, drilling fluid is pumped downwardly through the bore of the hollow drill string, out the bottom of the hollow drill string and then upwardly through the annulus defined by the drill string and the interior of the well casing, or well bore, and subsequently, and out through a side outlet above the well head. In reverse circulation, a pump impels drilling fluid through a port, down the annulus between the drill string and the well casing, or well bore, and then upwardly through the bore of the hollow drill string and out of the well.

Drilling heads typically include a stationary body, often referred to as a bowl, which carries a rotatable spindle such as a bearing assembly, rotated by a kelly apparatus or top drive unit. One or more seals or packing elements, sometimes referred to as stripper packers or stripper rubbers, is carried by a spindle to seal the periphery of the kelly or the drive tube or sections of the drill pipe, whichever may be passing through the spindle and the stripper rubber, and thus confine or divert the pore pressure in the well to prevent the drilling fluid from escaping between the rotating spindle and the drilling string.

As modern wells are drilled to ever deeper depths, greater temperature and pressures are encountered at the drilling head. These rigorous drilling conditions pose increased risks to rig personnel from accidental scalding, burns or contamination by steam, hot water and hot, caustic well fluids.

Rotating blowout preventers and diverters are well known to those of ordinary skill in the art of well pressure control. Rotation of the diverter/preventer is facilitated by a sealing engaged bearing assembly through which the drill string rotates relative to a stationary bowl or housing in which the bearing assembly is seated. Pressure control is achieved by means of one or more stripper rubbers connected to the bearing assembly and disposed around the drill string. At least one stripper rubber rotates with the drill string. Stripper rubbers typically taper downward and include rubber or other resilient material so that the down hole pressure pushes up on the rubber, pressing the rubber against the drill string to achieve a fluid-tight seal. Stripper rubbers often further include metal inserts that provide support for bolts or other attachment means and which also provide a support structure to minimize deformation of the rubber cause by down hole pressure acting on the rubber.

Stripper rubbers are connected or adapted to equipment of the drilling head to establish and maintain the pressure control seal around a down hole tubular. It will be understood by those skilled in the art that a variety of means are used to attach a stripper rubber to the equipment above it. Such attachment means include bolting from the top, bolting from the bottom, screwing the stripper rubber directly onto the equipment via cooperating threaded portions on the top of the stripper rubber and the bottom of the equipment, and clamps. It will also be understood that, depending on the particular equipment being used at a drilling head, a stripper rubber at one well may be connected to equipment specific to that well while at another well a stripper rubber is connected to different equipment. For example, at one well the stripper rubber may be connected to the bearing assembly while at another well the stripper rubber may be connected to an inner barrel or an accessory of the drilling head. While the present invention is described here in relation to connecting the stripper rubber to the bearing assembly, it will be evident that the invention contemplates connection of the stripper rubber to any desired equipment of the drilling head.

Typically, a rubber o-ring seal, or similar seal, is disposed between the stripper rubber and the bearing assembly to improve the connection between the stripper rubber and the bearing assembly. It is common practice to tighten the bolts or screws of the connection with heavy wrenches and sledge hammers. The practice of using heavy tools to tighten a bolt, for example, can result in over-tightening, to the point where the threads or the bolt head become stripped. The results of over-tightening include stripped heads, where the bolt or screw cannot be removed, or stripped threads, where the bolt or screw has no grip and the connection fails. Both results are undesirable.

Drilling head assemblies periodically need to be disassembled to replaced stripper rubbers or other parts, lubricate moving elements and perform other recommended maintenance. In some circumstances, stripped or over tightened bolts or screws make it very difficult if not impossible to disengage the stripper rubber from the drilling head assembly to perform recommended maintenance or parts replacement.

There is a danger of serious injury to rig workers when heavy tools are used to make a stripper rubber connection at the drilling head. The connection should be made quickly and achieve a fluid tight seal.

It is desirable, therefore, to obtain a connector for optionally connecting a stripper rubber assembly to a bearing assembly, or other equipment, of a drilling head that is effective, safe, simple, fast and elegant.

BRIEF DESCRIPTION OF THE DRAWINGS

The present invention is further described in the detailed description that follows, by reference to the noted drawings by way of non-limiting examples of embodiments of the present invention, in which like reference numerals represent similar parts throughout several views of the drawings, and in which.

DETAILED DESCRIPTION OF THE INVENTION

Figure 1A:
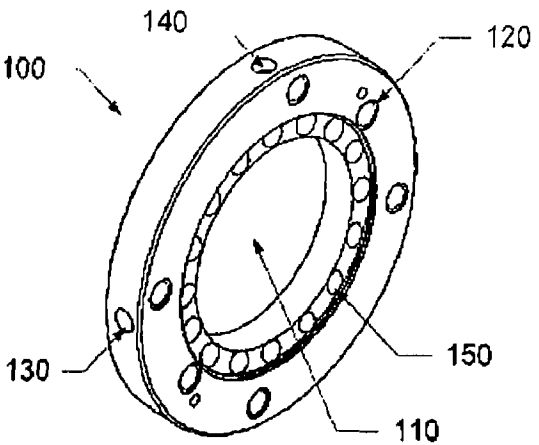
FIG. 1A is a perspective view schematic drawing of an adapter of one embodiment of the present invention.

In view of the foregoing, the present invention, through one or more of its various aspects, embodiments and/or specific features or sub-components, is thus intended to bring out one or more of the advantages that will be evident from the description. The present invention is described with frequent reference to stripper rubber adapters. It is understood that a stripper rubber adapter is merely an example of a specific embodiment of the present invention, which is directed generically to connectors and systems and methods for making connections within the scope of the invention. The terminology, therefore, is not intended to limit the scope of the invention.

Oil and gas wells are drilled with a drill bit attached to a hollow drill string which passes down through a well casing installed in the well bore. A drilling head attached to the top of the well casing, where it emerges from the ground to seal the interior of the well casing from the surface, permits the forced circulation or diversion of drilling fluid or gas during drilling operations. In the forward circulation drilling mode, the drilling fluid or gas is pumped down through the interior of the hollow drill string, out the bottom thereof, and upward through the annulus between the exterior of the drill string and the interior of the well casing. In reverse circulation, the drilling fluid or gas is pumped down the annulus between the drill string and the well casing and then upward through the hollow drill string.

Drilling heads often include a stationary body that carries a rotatable spindle such as a bearing assembly that is rotated by a kelly or top drive unit that drives the rotary drilling operation. A seal or packing, often referred to as a stripper rubber or packer, is carried by the spindle to seal the periphery of the kelly or the sections of drill pipe, whichever is passing through the spindle, and thereby confine the fluid pressure in the well casing and prevent the drilling fluid, whether liquid or gas, from escaping between the rotary spindle and the drill string.

Stripper packers provide rotational and slideable sealing of the drill string within the drilling head. The rotation of the kelly and drill string, the frequent upward and downward movement of the kelly and drill string during addition of drill pipe sections, and the high pressures to which the drilling head is subjected, demand that the consumable packing components of the drilling head be able to be quickly and securely replaced. As modern oil and gas wells go to greater depths having greater down hole bore pressures, ever more reliable means of sealing the drill string against release of internal drilling fluid pressure are sought.

The attachment of the stripper packer to the inner barrel of the wellhead is important in the containment or diversion of drilling fluid under bore hole pressure. Typically, the stripper packer includes an elongated generally cylindrical hard-rubber packer having an annular mounting collar secured to its upper end. The mounting collar of the packer, in turn, is secured onto the lower end of the spindle by any one of a variety of means, including bolting from the top, bolting from the bottom, screwing on with cooperating threaded potions or with a mounting clamp that is screwed or bolted tight for a positive mechanical interlock between the spindle mounting flange and the stripper rubber collar.

Some packers incur tearing of the stripper rubber or breaking of the fluid seal with the mounting clamp due to localized stress concentrations at the rubber to clamp interface. Increased cost of manufacture has resulted from the complexities of the molding process and the complex design of the mounting clamp.

The art has not produced many viable alternatives to the above-described structures due, in part, to the difficulty of forming a suitable releasable yet reliable connection between a drilling head and a stripper rubber. This has been particularly true in those cases where the frictional engagement between the stripper rubber and the drill string provides the rotary driving force for the rotary spindle in the drilling head. In such instances, the stripper rubber is under constant torque loading and this tends to accelerate wear and ultimate failure of the rubber-to-spindle seal.

The present invention provides a stripper rubber adapter that eliminates bolts, screws and clamps, and which is selectively detachable from the drilling head. When assembled, the stripper rubber adapter of the present invention optionally bolts to the bottom of the spindle of the drill head by the selectively lockable engagement of one or more cam locks and cam pins which maintain the stripper rubber in compressive engagement with the barrel to provide a fluid-tight and pressure-tight seal therebetween and to support rotary torque loads transmitted via the stripper rubber from the rotating drill string to the rotary spindle.

Turning now to the drawings, FIG. 1A is a perspective view schematic drawing of an adapter 100 of one embodiment of the present invention. The generally cylindrical shape of adapter 100 defines primary bore 110, through which a down hole tubular, such as a drill string, may be extended. More than one cam pin bores 120 extend through the width of adapter 100 and are spaced around adapter 100. Bores 120 accommodate cam pins such as depicted in FIGS. 3A–D.

More than one cam lock bores 130, spaced around the side of adapter 100, are slightly offset from bores 120 so that bores 120 and 130 intersect forming apertures 140. Bores 130 accommodate cam locks such as depicted in FIGS. 2A–E. Cam locks 200 matingly engage cam pins 300 through apertures 140.

Figure 1B:
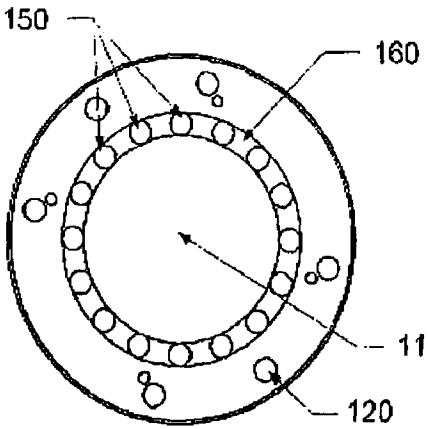
FIG. 1B is top view schematic drawing of the adapter of FIG. 1A.

FIG. 1B is top view schematic drawing of adapter 100. Primary bore 110 and cam pin bores 120 are shown looking down on the top of adapter 100. Threaded bores 150 disposed around annular inner surface 160 of adapter 100 provide means for screwing of bolting adapter 100 to the spindle of the drilling head.

Figure 1C:
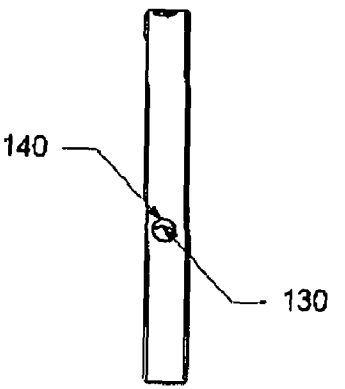
FIG. 1C is a side view schematic drawing of the adapter of FIG. 1A.

FIG. 1C is a side view schematic drawing of adapter 100. Looking through cam lock bore 130, aperture 140 can be seen.

Figure 1D:
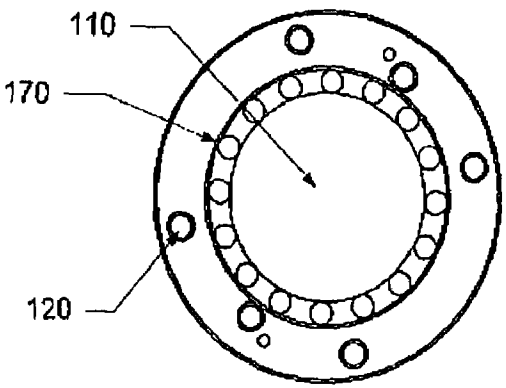
FIG. 1D is a bottom view schematic drawing of the adapter of FIG. 1A.

FIG. 1D is a bottom view schematic drawing of adapter 100. Groove 170 is formed to receive a sealing element, such as a gasket or an o-ring. One embodiment of the invention provides a stripper rubber having a mating annular ridge around the top of the stripper rubber such that the ridge fits into groove 170. An alternative embodiment provides the ridge coated in rubber or some other elastic or sealing material, such that when the ridge is pressed into groove 170, the sealing material around the ridge is compressed to enhance the effectiveness of the seal.

Figure 1E:
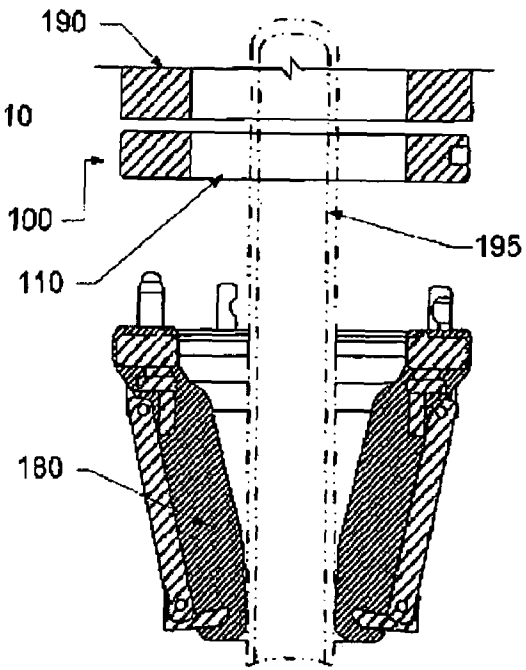
FIG. 1E is an exploded side view cross-section of a stripper rubber connection to drilling head equipment with an adapter of FIG. 1A.

FIG. 1E is an exploded side view cross-section of a stripper rubber connection to drilling head equipment with an adapter of FIG. 1A. Adapter 100 connects to stripper rubber 180 as described herein below and connects to equipment 190 also as described herein below. Down hole tubular 195 extends through equipment 190, adapter 100 through bore 110 and stripper rubber 180.

Figure 2:
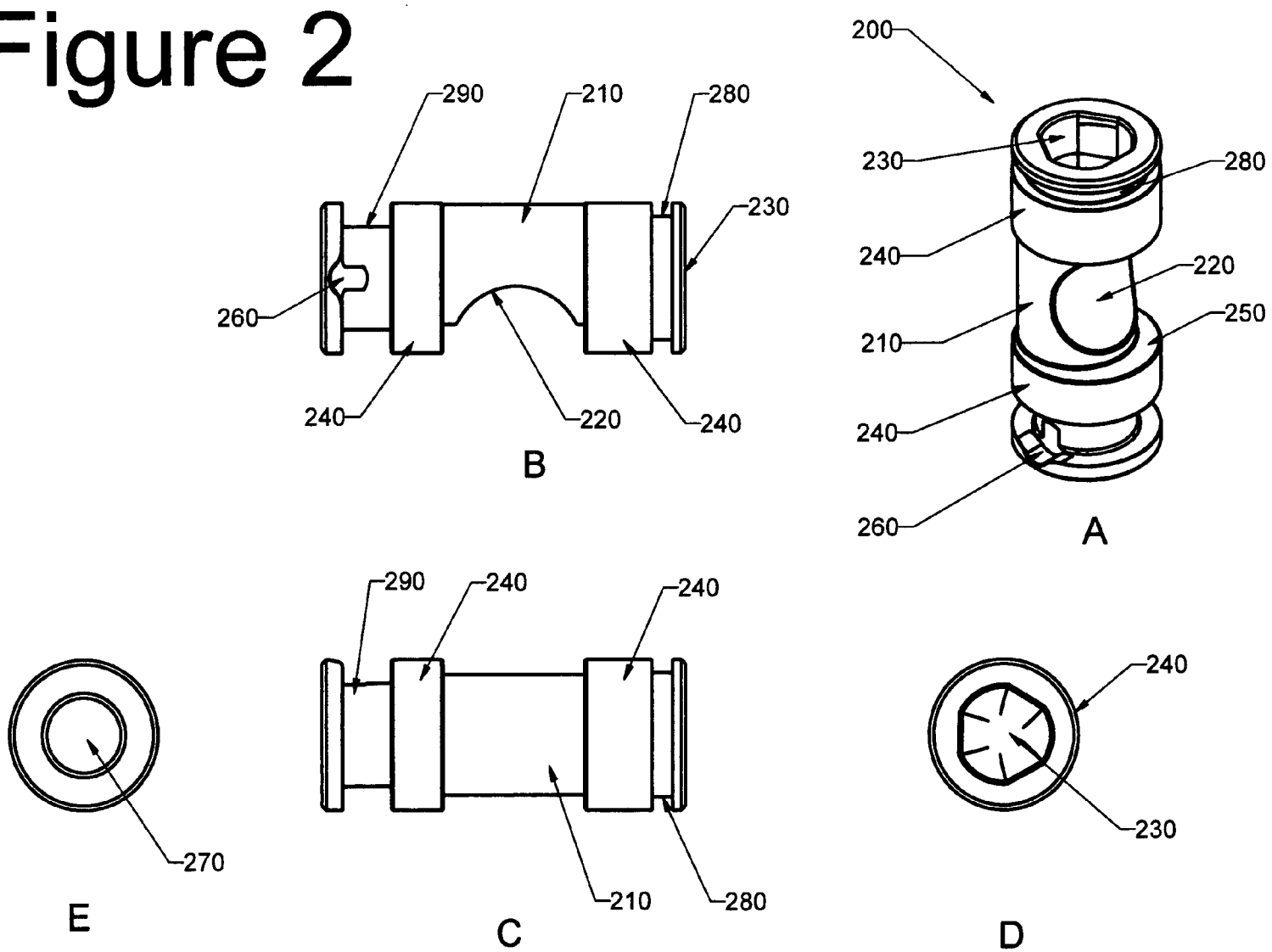
FIG. 2A is a perspective view schematic drawing of a cam lock of one embodiment of the present invention.
FIG. 2B is a horizontal side view schematic drawing of the cam lock of FIG. 2A.
FIG. 2C is a horizontal top view schematic drawing of the cam lock of FIG. 2A.
FIG. 2D is an axial top view schematic drawing of the cam lock of FIG. 2A.
FIG. 2E is an axial bottom view schematic drawing of the cam lock of FIG. 2A.

FIG. 2A is a perspective view schematic drawing of a cam lock 200 of one embodiment of the present invention. Cam lock body 210 has concave portion 220. The curvature of concave portion 220 is substantially equal to or less than the curvature of cam pin bore 120 (FIGS. 1A–C) and is also less than or equal to the curvature of cam pin body 310 of cam pin 300 such as depicted in FIGS. 3A–D. Cam lock head 230 is shaped to accommodate a wrench suitable for turning cam lock 200. Cam lock shoulder 240 is axially disposed on both sides of concave portion 220 and has a larger outer diameter than cam lock body 210. The outer diameter of shoulder 240, however, is small enough to fit within any of cam lock bores 130. The surfaces of cam lock shoulders 240 are, preferably, polished to facilitate full, or at least partial reciprocal rotation of cam lock 200 within bore 130 of adapter 100.

Cam lock body 210 is shaped to provide a bias which is depicted in FIG. 2A at surface 250 of shoulder 240. The bias is obtained by forming cam lock body 210 with a slightly ovoid circumference. The biased shape of cam lock body 210 operates on cam pin 300 so to pull cam pin 300 into a tight interference fit when the cam lock and cam pin are in a locked position relative to each other.

FIG. 2B is a horizontal side view schematic drawing of the cam lock of FIG. 2A. In the particular embodiment of the present invention depicted in this figure, the end of cam lock 200 distal from cam lock head 230 provides recess 260 that engages a spring-loaded stop when cam lock 200 is rotated to an unlocked position. The spring loaded stop provides an audible "snap" when it engages recess 260.

FIG. 2C is a horizontal top view schematic drawing of the cam lock of FIG. 2A. Groove 280 is adapted to receive an o-ring or other suitable sealing element. Groove 290, distal from groove 280, is adapted to receive the spring-stop described above, such that the spring-loaded stop acts to retain cam lock 200 within cam lock bore 130 when cam lock 200 is in an unlocked position.

FIG. 2D is an axial top view schematic drawing of the cam lock of FIG. 2A. Cam lock head 230 is formed to engage a wrench, such as a "T" wrench or Allen wrench, to rotate the cam. Head 230 may be formed to accommodate any desired wrench shape, including but not limited to, hex, square or triangular shapes. Triangular shapes are recommended because they are more resistant to stripping than other shapes. Although depicted here as a socket head to receive a "T" or Allen wrench, alternative embodiments provide an extended or protruding head 230 adapted for a socket wrench such as ratchet wrench.

FIG. 2E is an axial bottom view schematic drawing of the cam lock of FIG. 2A. Recess 270 is adapted to receive a spring or a spring-loaded element in cam lock bore 130 such that the spring applies force to cam lock 200 to enhance the frictional engagement of cam lock 200 with cam pin 300.

Figure 3:
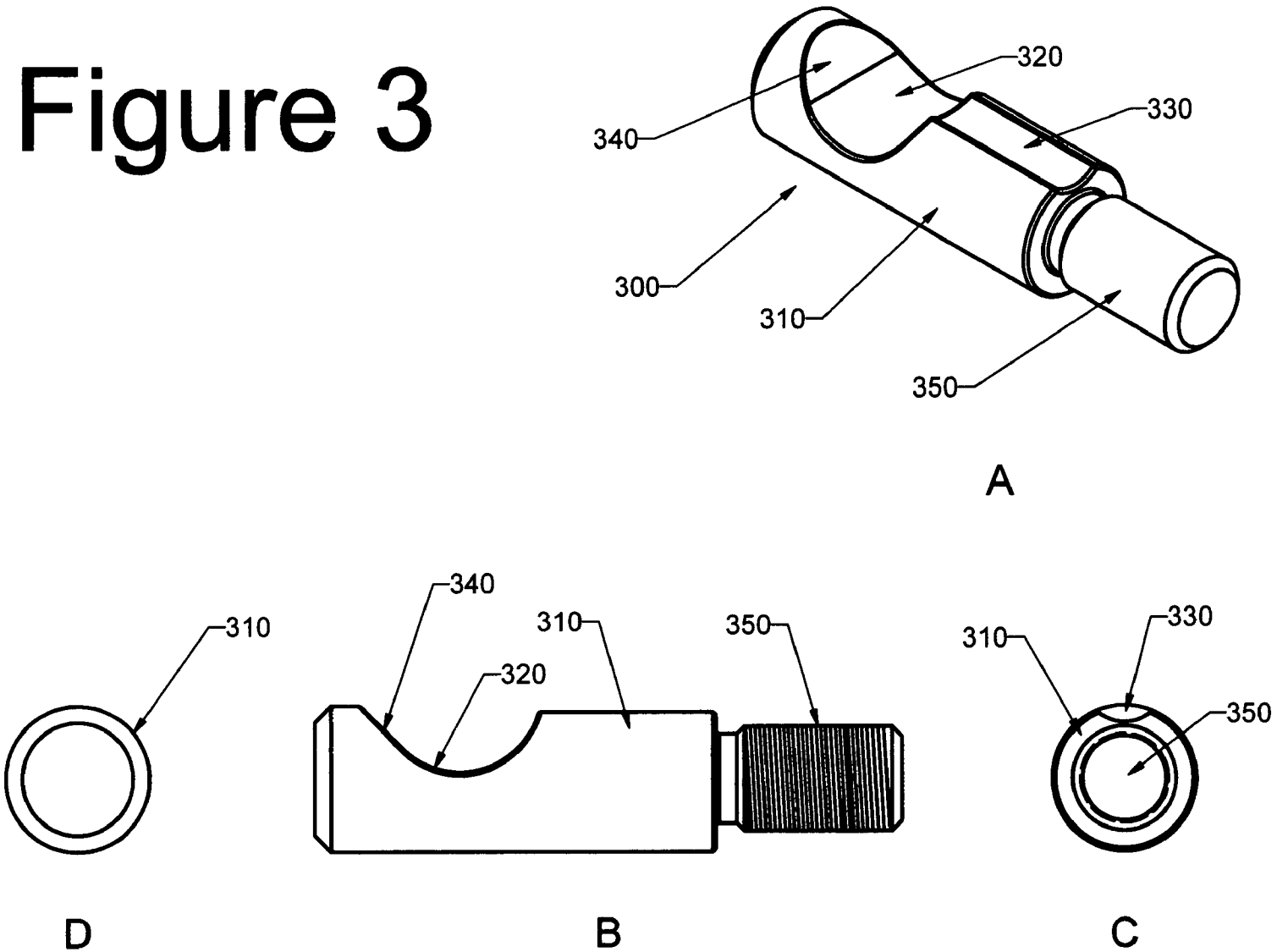
FIG. 3A is a perspective view schematic drawing of a cam pin of one embodiment of the present invention.
FIG. 3B is a horizontal side view schematic drawing of the cam pin of FIG. 3A.
FIG. 3C is an axial bottom view schematic drawing of the cam pin of FIG. 3A.
FIG. 3D is an axial top view schematic drawing of the cam pin of FIG. 3A.

FIG. 3A is a perspective view schematic drawing of cam pin 300 of one embodiment of the present invention. In the depicted embodiment, cam pin 300 has a cam pin body 310 at the distal end and a threaded end 350 at the proximate end. Cam pin body 310 provides concave portion 320 toward the distal end of cam pin body 310 and groove 330 at the proximate end of cam pin body 310. Threaded end 350 (threads not shown, see FIG. 3B) of cam pin 300 is disposed at the proximate end of cam pin 300. Threaded end 350 extends through cam pin bore 120 of adapter 100 and threadedly connects to a stripper rubber and cam pin body 310 is disposed within cam pin bore 120 of adapter 100.

FIG. 3B is a horizontal side view schematic drawing of the cam pin of FIG. 3A. Cam pin body 310 has concave portion 320 which has a curvature at most equal to the curvature of the bore 120 of adapter 100. Concave portion 320 includes oblique flat surface 340 that provides clearance to ensure that cam lock 200 properly engages concave portion 320. Threads are shown on threaded end 350, which threadedly attaches to a stripper rubber or a stripper rubber insert.

FIG. 3C is an axial bottom view schematic drawing of cam pin 300 of FIG. 3A. Groove 330 is adapted to engage a stop, such as a screw, on the stripper rubber assembly to inhibit excessive rotational movement of cam pin 300 but to allow an effective amount of movement of pin 300 to facilitate engagement of pin 300 with the cam lock 200. In addition, groove 330 serves as an orienting feature to facilitate effective positioning of cam pin 300 for engagement with cam lock 200.

FIG. 3D is an axial top view schematic drawing of the cam pin of FIG. 3A. From this perspective, pin body 310 obscures threaded end 350 due its larger outer diameter.

Figure 4:
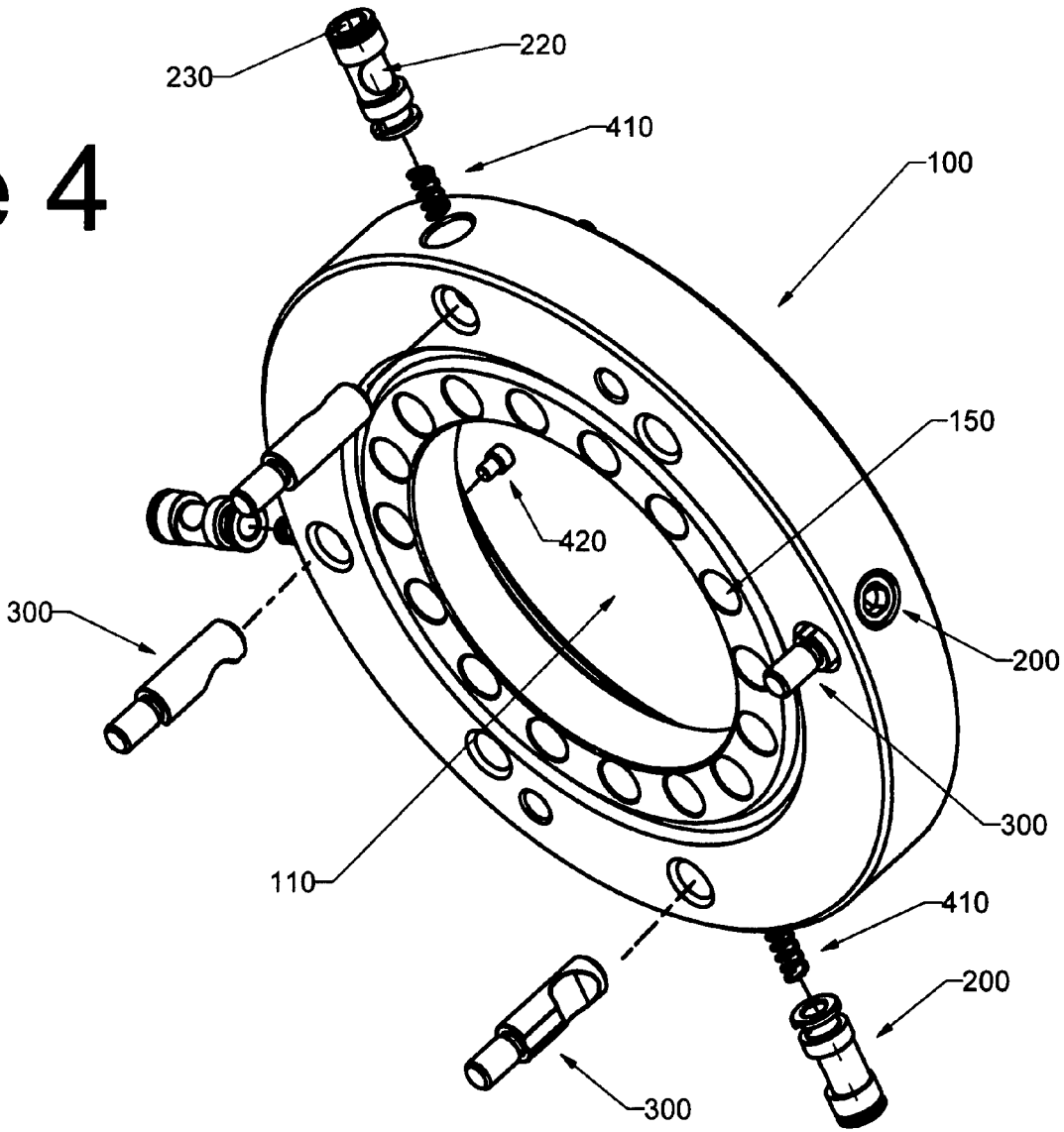
FIG. 4 is an exploded perspective view schematic drawing of one embodiment of an adapter of the present invention.

FIG. 4 is an exploded perspective view schematic drawing of one embodiment of an adapter 100 of the present invention. To connect a stripper rubber to a bearing assembly, spindle, inner barrel or other drilling head equipment, adapter 100 is fastened to the drilling head equipment by, for example, bolts extending through bores 150 to corresponding bores (not shown) on the equipment, and bolting adapter 100 to the equipment. One or more cam pins 300 extend through cam pin bores 120 so that threaded end 350 threadedly attaches to the stripper rubber. The stripper rubber may have one or more inserts or metal or some other durable material such that cam pins 300 connect with the insert of the stripper rubber. Cam pins 300 are oriented within cam pin bores 120 so that concave portion 320 of each pin 300 is parallel to the center line of primary bore 110. Groove 330 facilitates the proper orientation of pin 300 and, in one embodiment of the present invention, engages a stop structure, such as the head of a screw, to ensure proper rotational orientation of the cam pin within cam pin bore 120.

Threaded end 350 of each cam pin 300 is threadedly attached to a corresponding threaded bore in the metal insert of the stripper rubber. When cam pins 300 are connected to the stripper rubber, pins 300 are inaccessible within bores 120. The stripper rubber, however, is not attached to adapter 100 at this stage because pin bodies 310 simply slide out of bores 120.

One or more cam locks 200 are positioned in cam lock bores 130 of adapter 100 with the cam lock head 230 axially oriented so as to be exposed to the outer surface of adapter 100 and accessible to, for example, a wrench. Concave portion 220 of each cam lock 200 is axially oriented facing concave portion 320 of the corresponding cam pin 300 through aperture 140. Each cam lock 200 is rotated with the wrench until cam lock body 210 engages concave portion 320 of the corresponding cam pin 300, locking cam lock body 210 in concave portion 320 of the corresponding cam pin 300. The stripper rubber is effectively connected to the barrel, without clamps, bolts or threads, by locking together an effective number of cam locks 200 and cam pins 300.

One embodiment of the present invention provides a biased cam lock 200 that selectively pulls the stripper rubber assembly up tight against adapter 100, or which squeezes a sealing element between the stripper rubber and adapter 100, to form a fluid-tight seal between the stripper rubber and adapter 100. Biased cam locks 200 operate on cam pins 300 that are threadedly connected to the stripper rubber. The biasing mechanism may be accomplished with biased locks or biased pins or by an arrangement of the respective bores such that the locking engagement of the locks and pins is achieved during rotation of cam lock 200 whereby cam lock 200 engages enough of pin body 310 to pull the stripper rubber into tight proximity with adapter 100 and then locks into position by friction or interference fit with concave portion 320 for a fluid-tight seal. By providing a biased embodiment, the present invention obtains an advantage over prior art connections, which do not provide biased embodiments for ensuring a fluid-tight seal. The present invention contemplates both biased and unbiased embodiments.

It is good practice to periodically replace or maintain stripper rubbers because stripper rubbers tend to wear out. To replace a stripper rubber, the stripper rubber must be disconnected from the drilling head equipment. To disconnect a stripper rubber pursuant to the present invention, it is a simple matter of rotating cam locks 200 to disengage the locks from the pins by aligning the corresponding concave portions of each element. Cam pins 300 attached to the stripper rubber will then slide relatively easily out of cam pin bores 120 of adapter 100 and the stripper rubber is disconnected from the equipment. A new stripper rubber with cam pins 300 is connected to the equipment as described above.

Numerous variations of the present invention will be apparent to those of ordinary skill in the art from the preceding exemplary description. For example, adapter 100 of the present invention may be connected to the drilling head by any suitable means other than bolting. Examples of such other means include, but are not limited to, welding and screwing. That is, a threaded adapter may be screwed onto a threaded barrel.

Similarly, cam pins 300 are not limited to threaded means for connecting to a stripper rubber or a stripper rubber insert. Various alternative embodiments of the present invention include stripper rubber inserts having integral cam pins, welded cam pins, snap rings or other attachments that are, or will be, known to those in the art.

It will also be apparent that the present invention is not limited to a particular number or shape of bores, cam locks, cam pins or bolts. Safety and reliability, however, would seem to recommend two or more lock/pin pairings.

Although the invention has been described with reference to several exemplary embodiments, it is understood that the words that have been used are words of description and illustration, rather than words of limitation. Changes may be made within the purview of the appended claims, as presently stated and as amended, without departing from the scope and spirit of the invention in all its aspects. Although the invention has been described with reference to particular means, materials and embodiments, the invention is not intended to be limited to the particulars disclosed; rather, the invention extends to all functionally equivalent technologies, structures, methods and uses such as are within the scope of the appended claims.

The invention claimed is:

1. A connector for selectively connecting a stripper rubber to drilling head equipment of a well, the connector comprising:

a generally cylindrical adopter connectable to the equipment, wherein the adapter defines a primary bore to accommodate a down hole tubular, the adapter further comprising:

(i) one or more cam pin bores substantially parallel to the primary bore;

(ii) one or more corn lock bores at least partially perpendicular to the one or more cam pin bores, wherein the cam lock bores are positioned such that the corn pin bores and cam lock bores partially intersect to form an aperture; and (iii) an inner surface comprising a plurality of threaded bores substantially parallel to the primary bore.

2. The connector of claim 1, further comprising an O-ring groove along the outer diameter of the inner surface.

3. A connector system for connecting a stripper rubber to drilling head equipment of a well, the connector system comprising:

(a) a generally cylindrical adapter connectable to the equipment, wherein the adapter defines a primary bore to accommodate a down hole tubular, the adapter further comprising:

(i) one or more cam pin bores substantially parallel to the primary bore and adapted to house one or more can, pins;

(ii) one or more cam lock bores adapted to house one or more at least partially rotatable cam locks, wherein the cam lock bores are positioned such that the cam pin bores and cam lock bores partially intersect to form an aperture through which the cam locks engage the cam pins; and (iii) an inner surface comprising a plurality of threaded bores substantially parallel to the primary;

(b) one or more at least partially rotatable cam locks disposable within one or more of the cam lock bores; and (c) one or more cam pins disposable within one or more of the cam pin bores.

4. The connector system of claim 3, wherein the adapter further comprises an o-ring groove along the out diameter of the inner surface.

5. The connector system of claim 3, further comprising one or more springs disposable in one or more of the cam lock bores to provide a spring-biased force on one or more of the cam locks.

6. The connector system of claim 3, wherein one or more of the cam pins comprise a threaded end.

* * * * *

UNITED STATES PATENT AND TRADEMARK OFFICE

CERTIFICATE OF CORRECTION

PATENT NO. : 7,174,956 B2
APPLICATION NO. : 10/776325
DATED : February 13, 2007
INVENTOR(S) : John R. Williams et al.

It is certified that error appears in the above-identified patent and that said Letters Patent is hereby corrected as shown below:

Claim 1 at Col. 8, line 18: replace “adopter” with --adapter--

Claim 1 at Col. 8, line 24: replace “corn” with --cam--

Claim 1 at Col. 8, line 27: replace “corn” with --cam--

Signed and Sealed this

Fifth Day of June, 2007

JON W. DUDAS
*Director of the United States Patent and Trademark Office*